US008136359B2

(12) United States Patent
Stuttaford et al.

(10) Patent No.: US 8,136,359 B2
(45) Date of Patent: Mar. 20, 2012

(54) GAS TURBINE FUEL NOZZLE HAVING IMPROVED THERMAL CAPABILITY

(75) Inventors: Peter Stuttaford, Jupiter, FL (US); Paul Economo, Jupiter, FL (US); Khalid Oumejjoud, Riviera Beach, FL (US); Max Dufflocq, West Palm Beach, FL (US); Hany Rizkalla, Stuart, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 1134 days.

(21) Appl. No.: 11/953,162

(22) Filed: Dec. 10, 2007

(65) Prior Publication Data

US 2009/0145983 A1 Jun. 11, 2009

(51) Int. Cl.
*F02C 1/00* (2006.01)

(52) U.S. Cl. ..... 60/742; 60/800; 60/748; 60/737

(58) Field of Classification Search ..... 60/740, 60/742, 747, 804, 800, 748, 737
See application file for complete search history.

(56) References Cited

U.S. PATENT DOCUMENTS

| | | | | |
|---|---|---|---|---|
| 5,259,184 | A | 11/1993 | Borkowicz et al. | |
| 5,361,578 | A * | 11/1994 | Donlan | 60/800 |
| 5,505,045 | A * | 4/1996 | Lee et al. | 60/748 |
| 5,636,510 | A * | 6/1997 | Beer et al. | 60/39.23 |
| 5,685,139 | A * | 11/1997 | Mick et al. | 60/776 |
| 5,722,230 | A | 3/1998 | Cohen et al. | |
| 7,117,679 | B2 * | 10/2006 | Toon et al. | 60/740 |
| 2007/0003897 | A1 * | 1/2007 | Koizumi et al. | 431/354 |

* cited by examiner

*Primary Examiner* — William H Rodriguez
*Assistant Examiner* — Young Choi
(74) *Attorney, Agent, or Firm* — Shook, Hardy & Bacon L.L.P.

(57) ABSTRACT

Embodiments for minimizing relative thermal growth within a fuel nozzle of a gas turbine combustor are disclosed. Fuel nozzle configurations are provided in which a heating fluid is provided to one or more passages in a fuel nozzle from feed holes in the fuel nozzle base. The heating fluid passes through the fuel nozzle, thereby raising the operating temperature of portions of the fuel nozzle to reduce differences in thermal gradients within the fuel nozzle. Various fuel nozzle configurations and passageway geometries are also disclosed.

12 Claims, 10 Drawing Sheets

GAS TURBINE FUEL NOZZLE HAVING IMPROVED THERMAL CAPABILITY

TECHNICAL FIELD

The present invention relates to gas turbine engines. More particularly, embodiments of the present invention relate to an apparatus for reducing thermal growth differential within a fuel nozzle of a gas turbine combustor.

BACKGROUND OF THE INVENTION

Gas turbine engines operate to produce mechanical work or thrust. Specifically, land-based gas turbine engines typically have a generator coupled thereto for the purposes of generating electricity. There are a number of issues that affect the overall performance and durability of the engine components, especially the combustion section. By nature, the combustion process creates varying pressure oscillations and dynamics that can result in significant wear to the combustion hardware. Specifically, the pressure oscillations can cause mating hardware to vibrate and move relative to one another. Excessive combustion dynamics can cause premature wear of mating hardware such that the hardware must be repaired or replaced.

Gas turbine combustors can have multiple fuel circuits, depending on the quantity and location of the fuel nozzles as well as combustor operating conditions. These fuel circuits and the fuel nozzles that are in fluid communication with the fuel circuits can operate at different times and at different flow rates. Since the fuel nozzles are positioned in close proximity to a flamefront in the combustor, the fuel nozzles are exposed to extremely high temperatures. However, the fuel nozzles carry a fuel having a temperature significantly less than the operating environment, and as a result, the fuel nozzle experiences significant variations in temperature.

SUMMARY

The invention is defined by the claims below, not by this Summary, which is provided to introduce a selection of concepts in a simplified form that are further described below in the Detailed Description. Embodiments of the present invention are directed towards a system and method for, among other things, minimizing thermal growth within a fuel nozzle so as to reduce thermal stress levels in the fuel nozzle.

The present invention provides embodiments for a fuel nozzle configuration for a gas turbine combustor in which the fuel nozzle receives a heated fluid to elevate the operating temperature of the fuel nozzle so as to reduce the differences in thermal growth of the various fuel nozzle components and reduce thermal stress within the fuel nozzle. In an embodiment of the present invention a fuel nozzle is disclosed comprising an inner tubular member having a centermost passage, an intermediate tubular member surrounding the inner tubular member and forming a secondary passage therebetween, and an outer tubular member surrounding the intermediate tubular member and forming an outer passage. A plurality of injectors extend radially outward from the outer passage for injecting a fuel supply to the combustor from the outer passage while a base end comprises a plurality of feed holes that direct a supply of heating fluid to the secondary passageway. This heating fluid elevates the temperature of the intermediate tubular member to reduce thermal mismatch in the tube between the outer passage and secondary passage. In this embodiment, each of the tubular members are generally cylindrical, except the intermediate tubular member includes a corrugated bellows portion that is used to help compensate for movement caused by thermal growth.

In an additional embodiment, a fuel nozzle is disclosed comprising an inner tubular member having a centermost passage, an intermediate tubular member surrounding the inner tubular member and forming a secondary passage therebetween, and an outer tubular member surrounding the intermediate tubular member and forming an outer passage. A plurality of injectors extend radially outward from the outer passage for injecting a fuel supply to the combustor from the outer passage while a base end comprises a plurality of feed holes that direct a supply of heating fluid to the secondary passageway to elevate the temperature of the intermediate tubular member to reduce thermal mismatch in the tube between the outer passage and secondary passage. In this embodiment, each of the tubular members are generally cylindrical. In a variation of this embodiment, a shield is placed between the intermediate tubular member and the outer tubular member along a portion of the intermediate tubular member so as to provide a thermal shield to the intermediate tubular member.

In yet another embodiment of the present invention, a fuel nozzle is disclosed comprising a solid inner tubular member having a centermost passage and a solid outer tubular member surrounding the inner tubular member and forming an outer passage. A plurality of injectors extend radially outward from the outer passage for injecting a fuel supply from the outer passage to a combustor, while a base end comprises a plurality of feed holes that direct a supply of heating fluid to the centermost passageway to elevate the temperature of the inner tubular member to reduce thermal differential in the tube between the outer passage and the centermost passage.

In a further embodiment, a gas turbine combustor is provided comprising a combustion liner, a cap assembly, and an end cover having a plurality of fuel nozzles that have been previously disclosed. The end cover comprises a plurality of fuel nozzles that extend through openings in the cap assembly such that fuel supplied to the fuel nozzles is injected into the combustor for mixing with compressed air for combustion. Multiple embodiments of the combustor are disclosed in which different embodiments of the fuel nozzle, as previously disclosed, are used. A heating fluid, such as compressed air, is supplied to each of the fuel nozzles through feed holes in each fuel nozzle base. The compressed air elevates the operating temperature of at least one passageway of the fuel nozzle to reduce the thermal gradients in the fuel nozzle and lower thermal stresses caused by large thermal gradients.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components or combinations of components similar to the ones described in this document, in conjunction with other present or future technologies.

Figure 1:
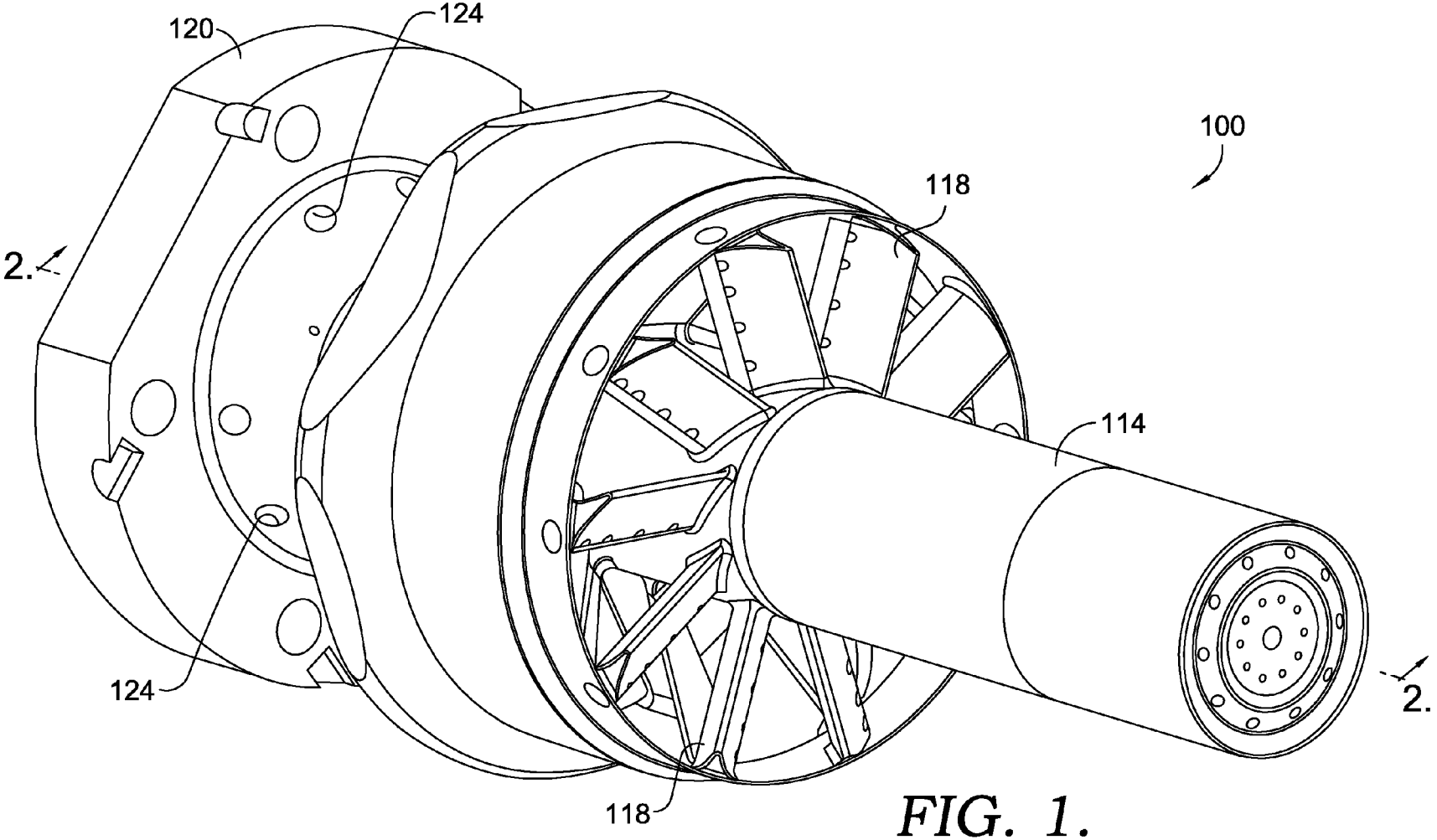
FIG. 1 depicts a perspective view of a fuel nozzle in accordance with an embodiment of the present invention.
Figure 2:
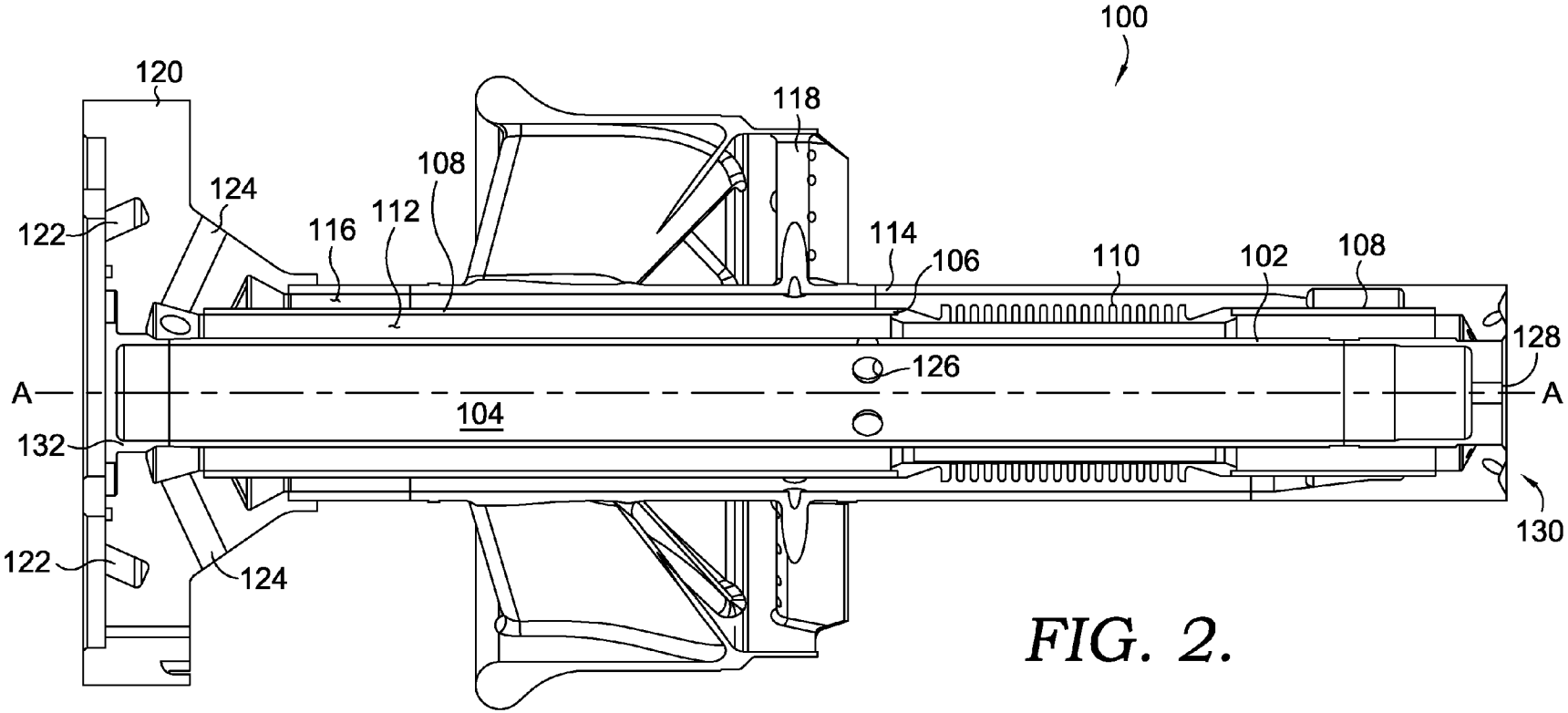
FIG. 2 depicts a cross section view taken through the fuel nozzle of FIG. 1 in accordance with an embodiment of the present invention.

Referring initially to FIGS. 1 and 2, a fuel nozzle 100 having reduced thermal growth is shown. The fuel nozzle 100 comprises an inner tubular member 102 that is coaxial with a centerline A-A and has a centermost passage 104. Surrounding the inner tubular member 102 is an intermediate tubular member 106. For the embodiment depicted in FIG. 2, the intermediate tubular member 106 has cylindrical portions 108 and a corrugated bellows portion 110. The corrugated bellows portion 110, which is designed to provide flexibility and axial movement of the intermediate tubular member 106, is fixed to, and between, the cylindrical portions 108 to form the intermediate tubular member 106. Defined between the intermediate tubular member 106 and the inner tubular member 102 is a secondary passage 112.

Located radially outward of and surrounding the intermediate tubular member 106 is an outer tubular member 114. The outer tubular member 114 is positioned such that an outer passage 116 is formed between the outer tubular member 114 and the intermediate tubular member 106. Extending radially outward from the outer passage 116 and therefore in fluid communication with the outer passage 116 are a plurality of injectors 118. These injectors 118 serve to inject a flow of fuel from the outer passage 116 into a combustor, which will be explained in further detail below.

Coupled to the intermediate tubular member 106 and outer tubular member 114 is a base 120. The base 120 provides a location at which the fuel nozzle 100 is mounted to a fuel source, as will be discussed in further details below. For the embodiment depicted in FIGS. 1 and 2, fuel is directed through one or more fuel passages 122 in the base 120 and into the outer passage 116. Also positioned in the base 120 are a plurality of feed holes 124 that are oriented at an angle relative to the centerline A-A. The feed holes 124 are a way of directing a heating fluid, such as compressed air, into the secondary passage in order to elevate the temperature of the intermediate tubular member 106. The heating fluid has a temperature that is initially greater than a temperature of fuel that passes through the outer passage 116. Elevating the temperature of the intermediate tubular member 106 serves to reduce the difference in thermal growth that occurs between portions of the fuel nozzle 100 exposed to extremely high operating temperatures and those exposed to cooler temperatures, such as the fuel that surrounds intermediate tubular member 106. To further aid in reducing effects of the thermal gradients, the inner tubular member 102 also comprises a plurality of holes 126 that are located proximate a mid-span of the inner tubular member 102 such that a portion of the heated fluid is directed through the secondary passage 112 and is passed through to the centermost passage 104. The heated fluid then passes through the centermost passage 104 and through one or more openings 128 at a tip 130 of the fuel nozzle 100. An end cap 132 is positioned at an end of the inner tubular member 102, opposite of the tip 130, to ensure the heated fluid flows towards the one or more openings 128.

It has been determined that the level of thermal benefit achieved by supplying a heated fluid to the secondary passage is also dependent on the geometry of the passageways. For example, for the fuel nozzle 100 depicted in FIGS. 1 and 2, it has been estimated that the overall axial thermal growth of the inner tubular member of the fuel nozzle 100 has increased compared to prior art nozzle designs. As a result of the overall reduced relative thermal growth, the overall stress has also been reduced. In order to obtain the optimal temperatures of the various tubular members so as to reduce thermal gradients, it is preferred that the tubular members maintain a specific diameter ratio so that the velocity of the heating fluid is maintained at a desired level. That is, for the embodiment of the fuel nozzle depicted in FIGS. 1 and 2, it is preferred that the ratio of diameters between the inner tubular member 102 and intermediate tubular member 106 is approximately 0.65.

Figure 3:
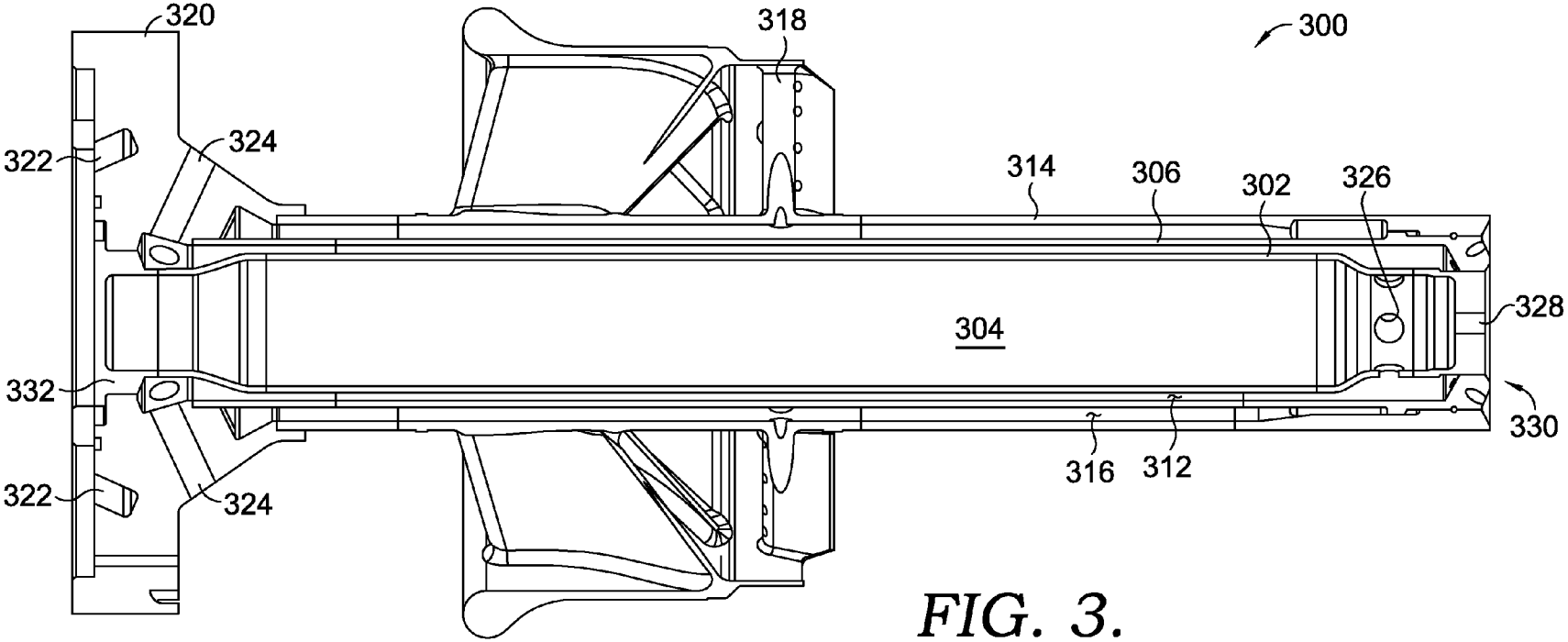
FIG. 3 depicts a cross section view of a fuel nozzle in accordance with an alternate embodiment of the present invention.

Referring now to FIG. 3, an alternate embodiment of the present invention is depicted in a cross sectional view. The fuel nozzle 300 shares a number of similar features to those depicted in FIGS. 1 and 2 and therefore, similar sequential identifiers will be used where possible to discuss similar components. The fuel nozzle 300 comprises an inner tubular member 302 that is coaxial with a centerline A-A and has a centermost passage 304. Surrounding the inner tubular member 302 is an intermediate tubular member 306. Defined between the intermediate tubular member 306 and the inner tubular member 302 is a secondary passage 312.

Located radially outward of and surrounding the intermediate tubular member 306 is an outer tubular member 314. The outer tubular member 314 is positioned such that an outer passage 316 is formed between the outer tubular member 314 and the intermediate tubular member 306. Extending radially outward from the outer passage 316 and therefore in fluid communication with the outer passage 316 are a plurality of injectors 318. These injectors 318 serve to inject a flow of fuel from the outer passage 316 into a combustor, which will be explained in further detail below.

Coupled to the intermediate tubular member 306 and outer tubular member 314 is a base 320. The base 320 provides a location at which the fuel nozzle 300 is mounted to a fuel source, as will be discussed in further details below. For the embodiment depicted in FIG. 3, fuel is directed through one or more fuel passages 322 in the base 320 and into the outer passage 316 where it then enters one of the plurality of injectors 318. Also positioned in the base 320 are a plurality of feed holes 324 that are oriented at an angle relative to the centerline A-A. These feed holes 324 are a way of directing a heating fluid, such as compressed air, into the secondary passage in order to elevate the temperature of the intermediate tubular member 306. Elevating the temperature of the intermediate tubular member 306 serves to offset the thermal mismatch that occurs between portions of the nozzle exposed to extremely high operating temperatures and those exposed to cooler temperatures, such as the fuel that surrounds intermediate tubular member 306. To further aid in reducing effects of the thermal gradients, the inner tubular member 302 also comprises a plurality of holes 326 that are located proximate an end of the inner tubular member 302 such that a portion of the heated fluid is directed through the secondary passage 312 and is passed through the centermost passage 304. The heated fluid then passes through one or more openings 328 at a tip 330 of the fuel nozzle 300. An end cap 332 is positioned at an end of the inner tubular member 302 opposite of the tip 330. This end cap ensures the heated fluid flows towards the one or more openings 328.

It has been determined that the level of thermal benefit achieved by supplying a heated fluid to the secondary passage is also dependent on the geometry of the passageways. For example for the fuel nozzle 300 depicted in FIG. 3, it has been estimated that overall axial thermal growth differential of the fuel nozzle is now only approximately 35% of prior art nozzle designs. As a result of the reduced thermal growth, overall stress has also been reduced to allow for operation of the fuel nozzle, but without a corrugated bellows section. As such, in order to obtain the optimal temperatures of the various tubular members so as to reduce thermal mismatches, it is preferred that the ratio of diameters between the inner tubular member 302 and intermediate tubular member 306 is approximately 0.86.

Figure 4A:
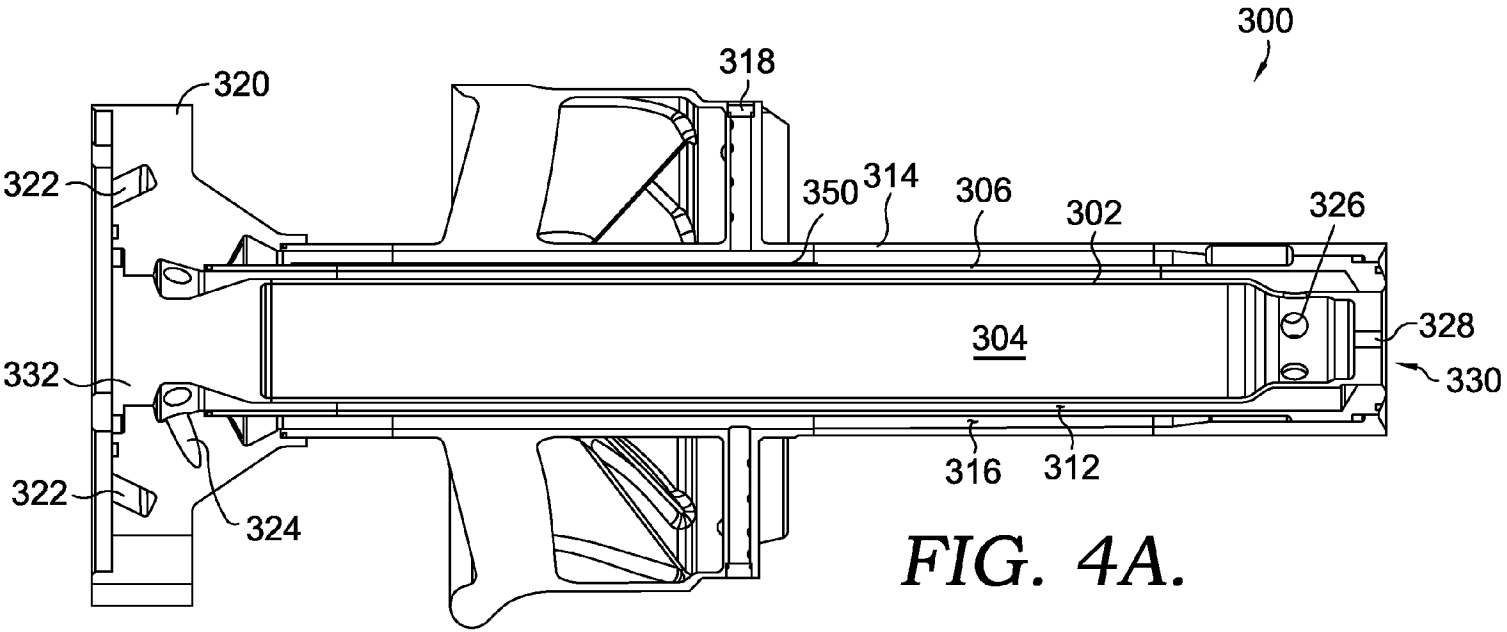
FIGS. 4A and 4B depict cross sectional views of the fuel nozzle of FIG. 3 in accordance with an alternate embodiment of the present invention.
Figure 4B:
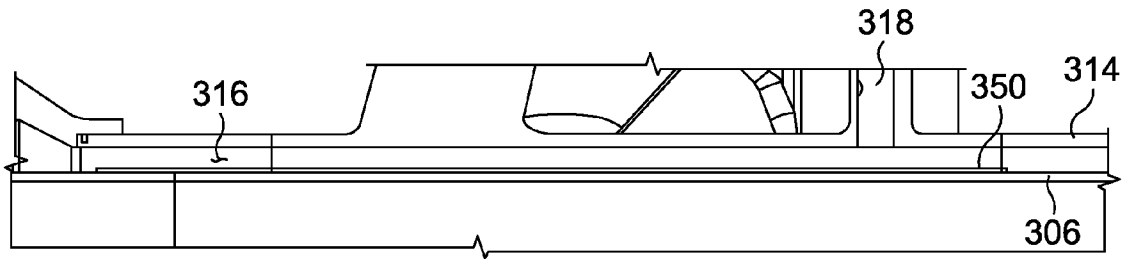

An alternate configuration of the fuel nozzle 300 is depicted in FIGS. 4A and 4B. This fuel nozzle is similar to that previously discussed and depicted in FIG. 3, but also includes a thermal shield 350. The shield 350 is provided around a portion of the intermediate tubular member 306 in order to remove a high heat transfer coefficient on a wall of the intermediate tubular member 306 that is directly in contact with the fuel. This configuration reduces the temperature reduction of the heating fluid in the centermost passage 304 by the fuel, keeping the heating fluid at a higher temperature and promoting thermal growth. The shield 350, which in the embodiment shown in FIGS. 4A and 4B is approximately 0.015 inches thick and fabricated from a stainless steel alloy, is only fixed to the intermediate tubular member 306 at a single end, proximate the base 320. This arrangement eliminates any thermal stress in the shield and allows it to freely move due to any thermal gradients present. A nominal gap of approximately 0.002" is created between the shield 350 and the intermediate tubular member 306.

An objective of the shield 350 is to effectively insulate fuel in the outer passage 316 from the intermediate tubular member 306 to maximize the temperature of the intermediate tubular member and its thermal growth. This will effectively minimize the relative thermal growth between the outer and intermediate tubular members. A similar effect can also be achieved by enhancing the heat transfer on a side of the intermediate tubular member 306 exposed to the heated fluid through the use of trip strips, surface roughening, or other means, with the goal being to maximize thermal growth of the intermediate tubular member 306 and minimize relative thermal displacement between the tubular members.

Figure 5:
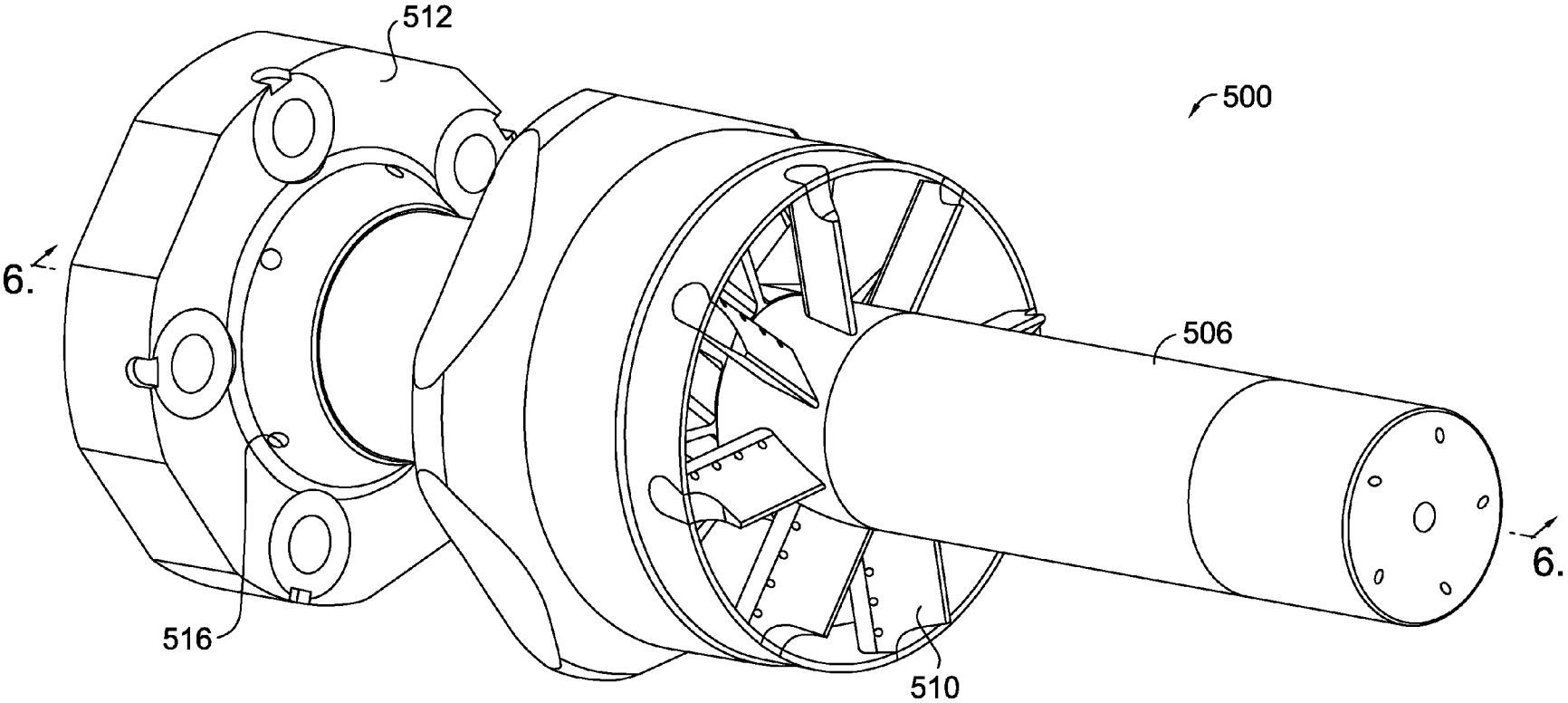
FIG. 5 depicts a perspective view of a fuel nozzle in accordance with yet another embodiment of the present invention.
Figure 6:
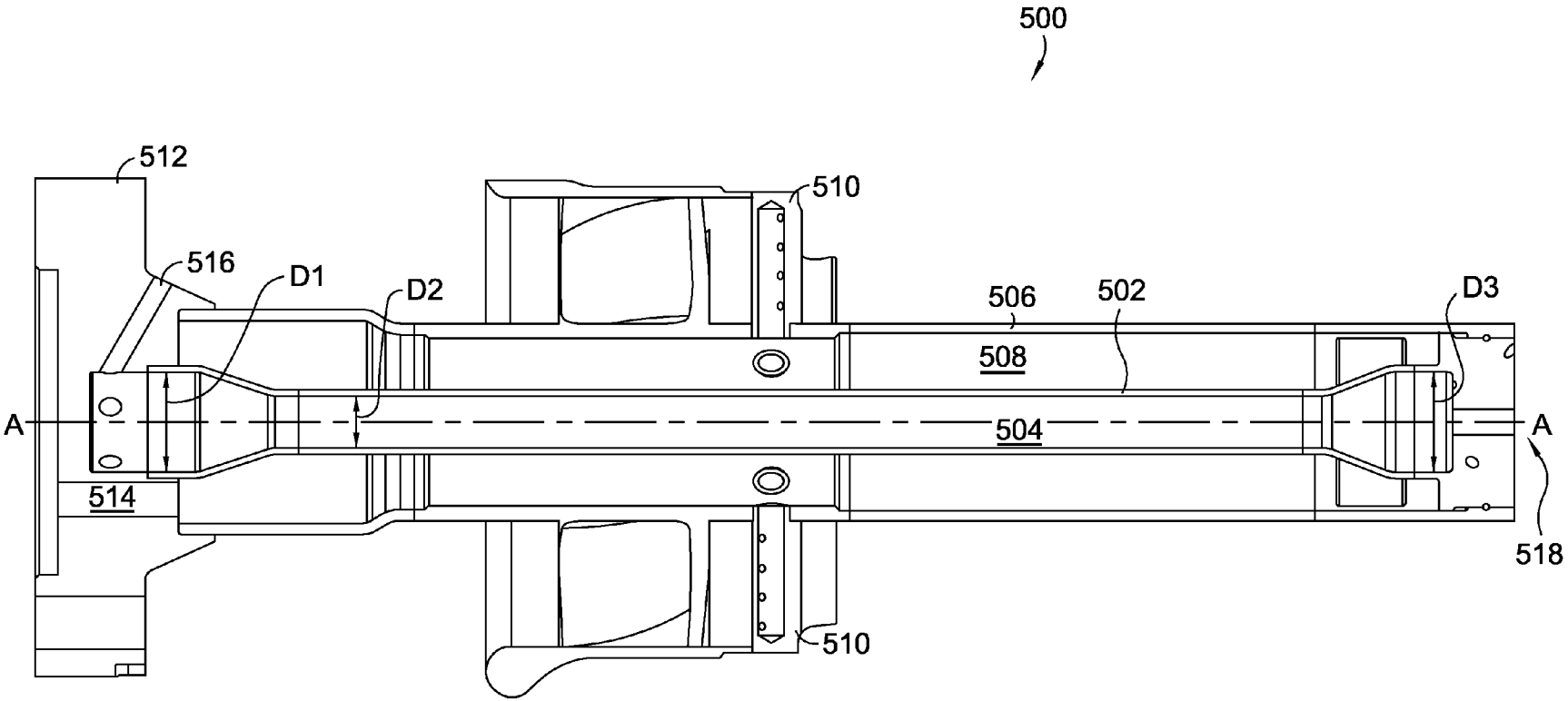
FIG. 6 depicts a cross sectional view of the fuel nozzle depicted in FIG. 5 in accordance with yet another embodiment of the present invention.

Referring now to FIGS. 5 and 6, yet another alternate embodiment of a fuel nozzle having a reduced relative thermal growth is depicted. A fuel nozzle 500 comprises a solid inner tubular member 502 located coaxial with a centerline A-A and having a centermost passage 504. Surrounding the inner tubular member 502 is a solid outer tubular member 506. The terminology "solid" is not meant to indicate that there are not breaks along a length of the tubular member 506, but rather the tubes are generally cylindrical along their entire length and do not include a corrugated bellows portion as in the embodiment depicted in FIG. 2. An outer passage 508 is formed between the inner tubular member 502 and outer tubular member 506.

Extending radially outward from the outer passage 508 are a plurality of injectors 510. These injectors 510 are in fluid communication with the outer passage 508 and serve to inject a fuel into a combustor, as will be described in more detail below. Coupled to each of the tubular members 502 and 506 is a base 512 that supplies a fuel to the outer passage 508 through one or more passages 514. In an embodiment of the fuel nozzle 500, the base 512 also has a plurality of feed holes 516 that are oriented at an angle relative to the centerline A-A. These feed holes 516 receive a heated fluid, such as compressed air, and direct the heated fluid to the centermost passage 504 so as to elevate the temperature of the inner tubular member 502. Raising the temperature of the inner tubular member 502 reduces the thermal differences between components of the fuel nozzle 500, which thereby reduces thermal stresses in the fuel nozzle 500.

It has been determined that the level of thermal benefit achieved by supplying a heated fluid to the centermost passage 504 is also impacted by the geometry of the passageways of the fuel nozzle 500. For example, it has been determined that in order to provide the benefits discussed above in a nozzle having a smaller diameter of the outer tubular member 506, such as that shown in FIG. 5, it is preferred, although not required, for the inner tubular member 502 to taper from a first diameter D1 to a smaller second diameter D2 and then to a larger diameter D3 adjacent a tip 518 of the fuel nozzle 500. This tapering of diameters is preferred because velocities and heat transfer coefficients necessary to minimize relative thermal growth can be controlled. Due to its smaller size, an embodiment of the fuel nozzle 500, can be located along a center axis of a gas turbine combustor. This fuel nozzle 500 has preferred diameter ratios D1/D2 of approximately 2.0 and D3/D2 of approximately 2.0 that provide the necessary velocity to the heating fluid to achieve the desired temperature change in the inner tubular member 502 so as to reduce the thermal gradients between tubular components. For this embodiment, it is estimated that overall thermal growth on the diameter of the fuel nozzle 500 is now only approximately 35% of prior art nozzle designs operating under similar conditions. As a result of the reduced thermal growth, overall stress has also been reduced by a similar level.

Figure 7:
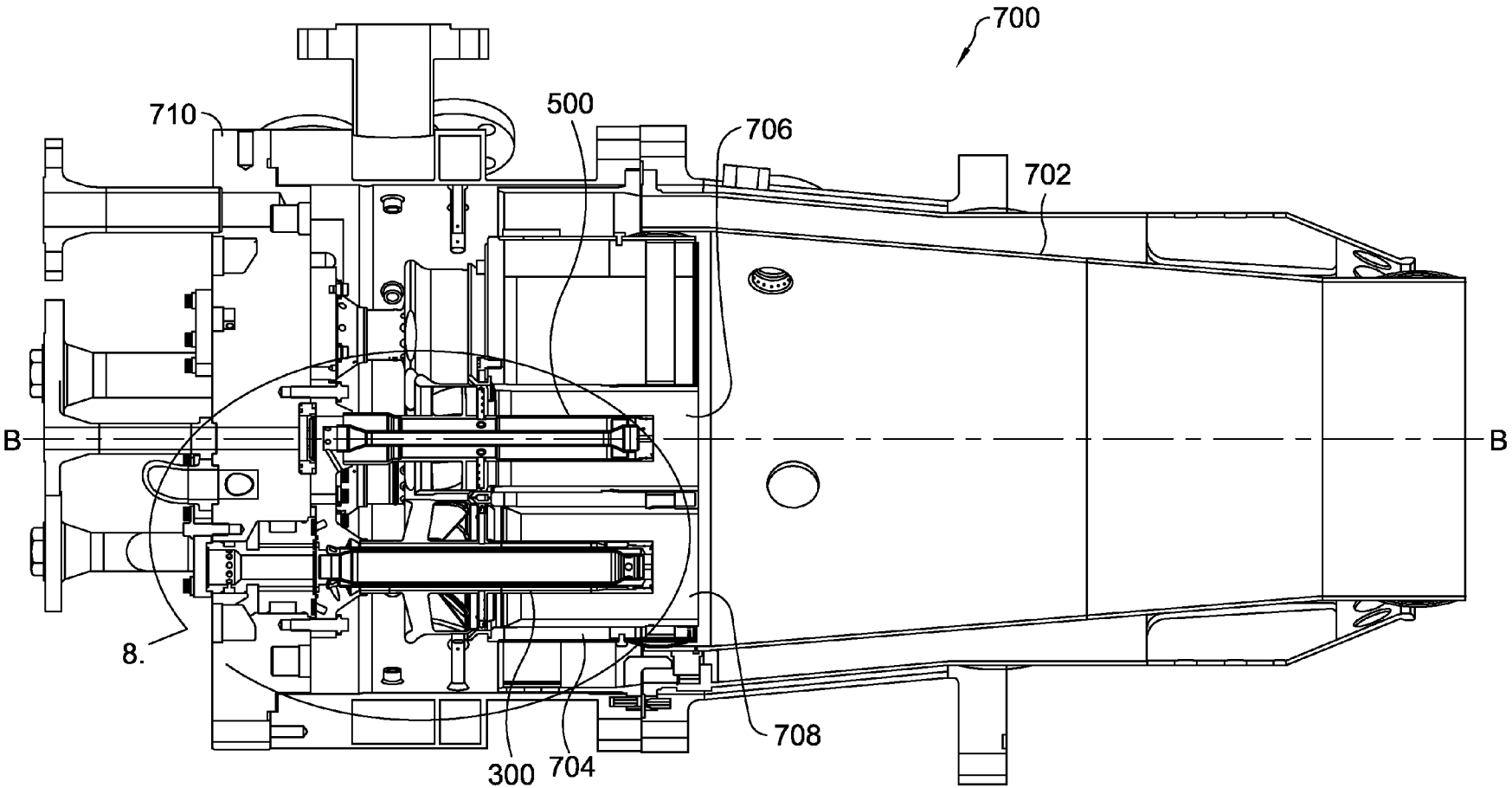
FIG. 7 depicts a cross sectional view of a gas turbine combustor that utilizes fuel nozzle embodiments depicted in FIGS. 3 and 6 in accordance with an embodiment of the present invention.
Figure 8:
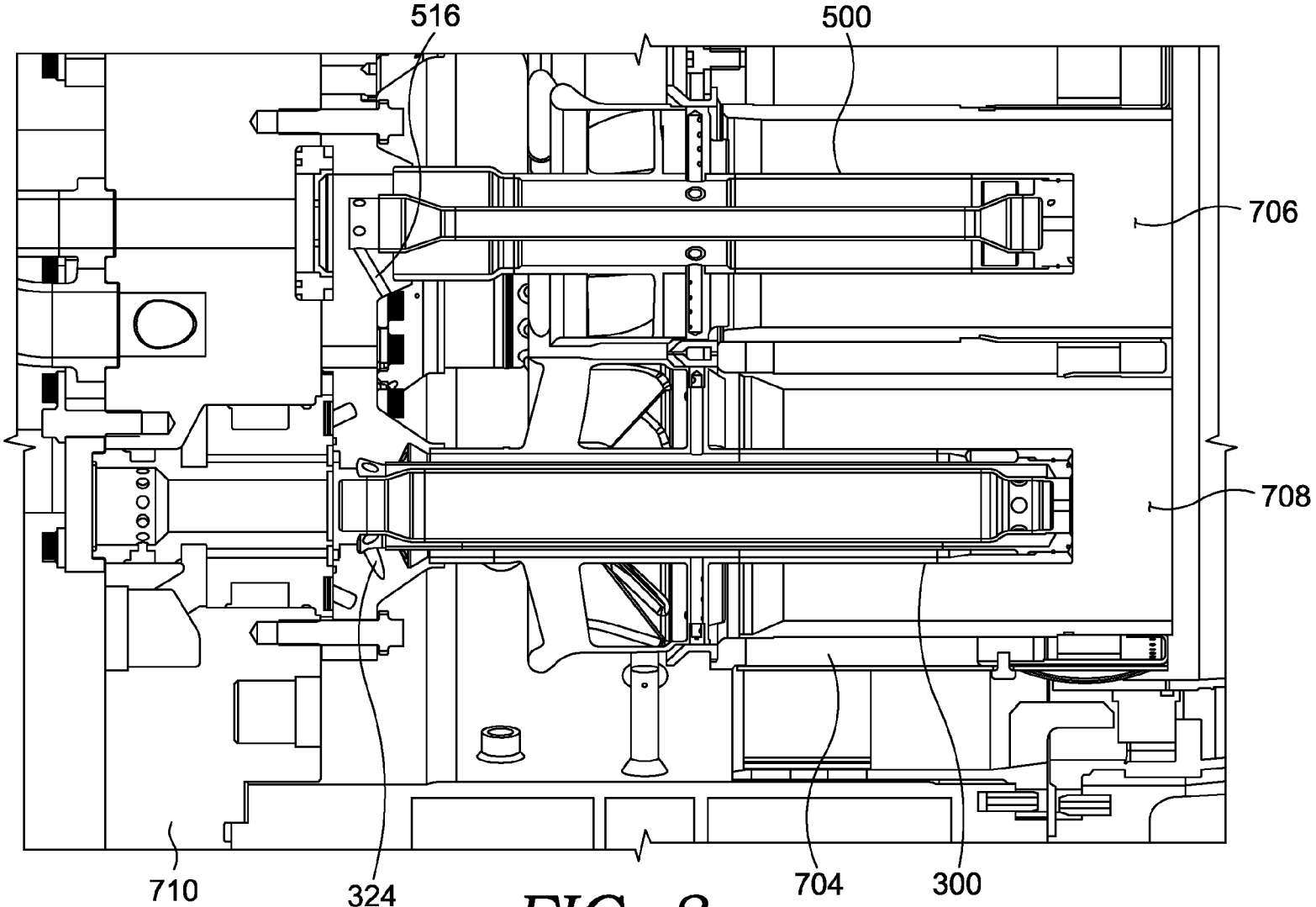
FIG. 8 depicts a more detailed cross sectional view of a portion of the gas turbine combustor of FIG. 7 in accordance with an embodiment of the present invention.

Referring now to FIGS. 7 and 8, a gas turbine combustor 700 is disclosed in which embodiments of the present invention fuel nozzle operate. The combustor 700 comprises a combustion liner 702 having a center axis B-B. A cap assembly 704 is positioned adjacent to a forward end of the combustion liner 702, where the cap assembly 704 has a central opening 706 located along the center axis B-B and a plurality of openings 708 located in an annular array about the center axis B-B.

Positioned adjacent to the cap assembly 704 is an end cover 710, which has a plurality of fuel nozzles fixed to the end cover 710, with each fuel nozzle corresponding to one of the openings 706 and 708 of the cap assembly. For example, referring to FIGS. 7 and 8, a first fuel nozzle 500, as previously depicted in FIGS. 5 and 6, is positioned along the center axis B-B and a plurality of second fuel nozzles 300, as previously depicted in FIG. 3, are positioned in an annular array about the center axis B-B and correspond to the openings 708. Since the fuel nozzles 300 and 500 that are used in the combustor 700 have previously been discussed in detail, further discussion of the fuel nozzles is not necessary. However, overall function of the combustor 700 will be discussed in further detail below.

Although the fuel nozzles 300 and 500 can be used in a variety of combustors, they are depicted for illustrative purposes in a single stage combustor which uses a single fuel nozzle 500 along a center axis B-B of the combustor 700 and a plurality of fuel nozzles 300 in an annular array about the single fuel nozzle 500. Depending on the mode of operation, various fuel nozzles can be flowing fuel so as to minimize the emissions levels and combustor noise, depending on the engine operating conditions. For example, in one operating condition, two or more of the fuel nozzles 300 simultaneously inject a fuel into the combustion liner 702 while fuel is restricted to the fuel nozzle 500. However, in an alternate operating condition, such as during start-up of the engine two or more of the fuel nozzles 300 and the fuel nozzle 500 located along the center axis of the combustor all inject a fuel into the combustion liner 702.

In operation, compressed air is directed along the outside of the combustion liner 702 and travels towards the end cover 710. A majority of the compressed air is turned into the combustion liner 702 by the end cover 710 in conjunction with the cap assembly 704 and is directed through the swirlers of the fuel nozzles 300 and 500 where the air mixes with fuel being injected by the fuel nozzles 300 and 500. However, a portion of the air enters the feed holes 324 and 516 of the fuel nozzles 300 and 500, as previously discussed, in order to raise the temperature of a fuel nozzle internal passageway to reduce thermal growth differences that occurs between adjacent parts of the fuel nozzle. As a result thermal stresses within the fuel nozzles 300 and 500 are lowered.

Figure 9:
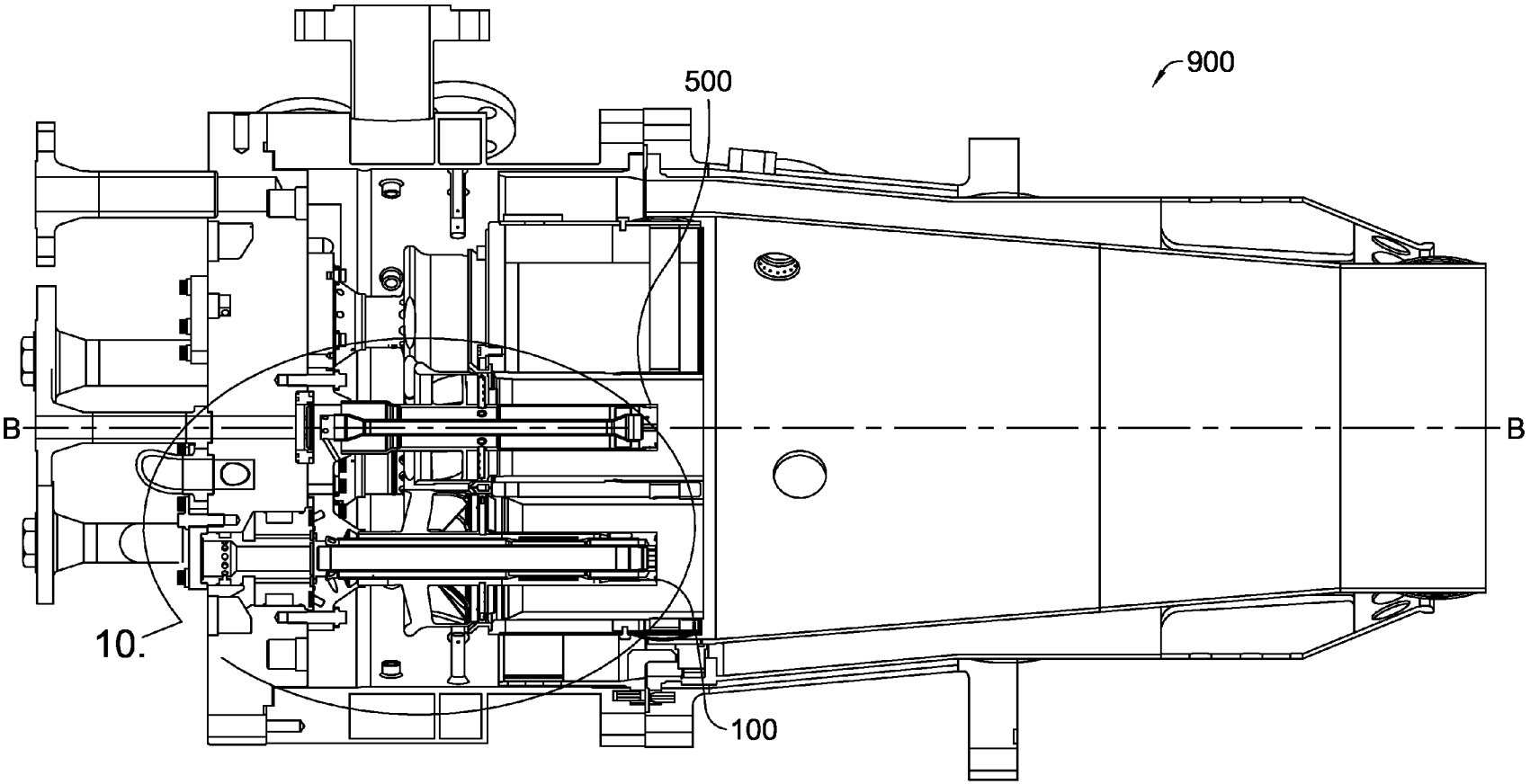
FIG. 9 depicts a cross section view of a gas turbine combustor that utilizes fuel nozzle embodiments depicted in FIGS. 2 and 6 in accordance with an additional embodiment of the present invention.
Figure 10:
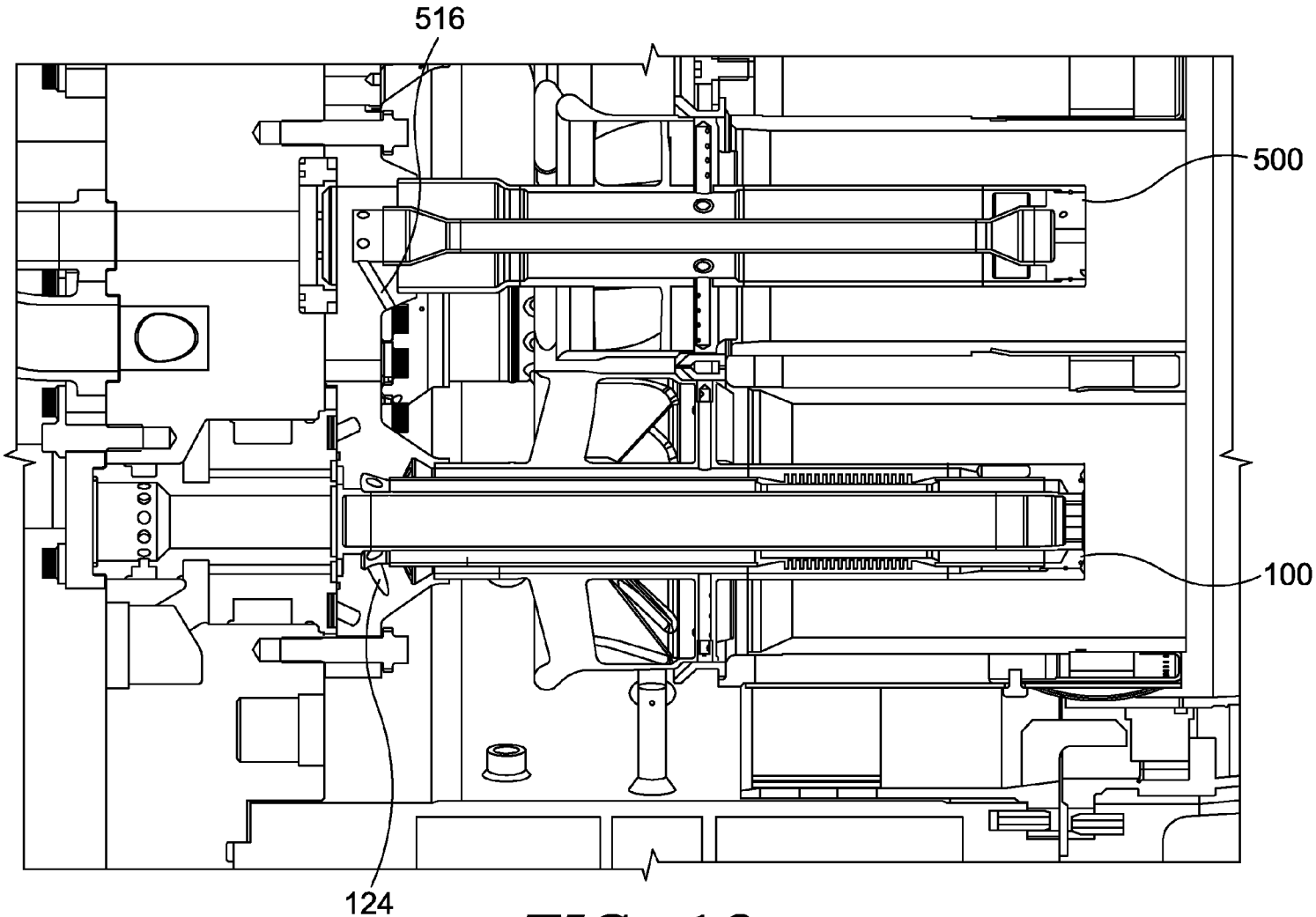
FIG. 10 depicts a more detailed cross sectional view of a portion of the gas turbine combustor of FIG. 9 in accordance with an additional embodiment of the present invention.

In yet another alternate embodiment, FIGS. 9 and 10 depict a combustor 900 similar the combustor 700 depicted in FIGS. 7 and 8, although the combustor 900 utilizes an alternate embodiment of the present invention fuel nozzle in the outer array. For the combustor 900, a single fuel nozzle 500 is positioned generally along a combustor axis B-B, while a plurality of fuel nozzles 100 are located in an annular array about the fuel nozzle 500. The remaining features and operation of the combustor 900 are substantially similar to those previously discussed with respect to the combustor 700 and will therefore not be discussed in any further detail.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A fuel nozzle for a gas turbine engine comprising:

an inner tubular member coaxial with a centerline, the inner tubular member having a centermost passage;

an intermediate tubular member surrounding the inner tubular member and having a corrugated bellows portion, the intermediate tubular member and inner tubular member forming a secondary passage therebetween;

an outer tubular member surrounding the intermediate tubular member such that the outer tubular member and the intermediate tubular member form an outer passage therebetween;

a plurality of injectors extending radially outward from the outer passage; and, a base coupled to at least the outer tubular member and the intermediate tubular member, the base comprises a plurality of feed holes oriented at an angle relative to the centerline and extending to a surface of the base within the gas turbine combustor for directing compressed air received from within a gas turbine combustor directly to the secondary passage so as to elevate a temperature of the intermediate tubular member to reduce thermal gradients in the fuel nozzle.

2. The fuel nozzle of claim 1, wherein the inner tubular member has a plurality of holes proximate a mid-span of the inner tubular member.

3. The fuel nozzle of claim 2, wherein a portion of the heated fluid is directed through the secondary passage and is passed through the centermost passage.

4. The fuel nozzle of claim 1, wherein the inner tubular member has an end cap positioned to close off the inner tubular member at the base.

5. The fuel nozzle of claim 1, wherein the bellows portion is welded to a cylindrical portion of the intermediate tubular member.

6. The fuel nozzle of claim 5, wherein the bellows portion is located between cylindrical portions of the intermediate tubular member.

7. The fuel nozzle of claim 1, wherein the inner tubular member has a first diameter and the intermediate tubular member has a second diameter such that a ratio between the first diameter and second diameter is at least 0.65.

8. A gas turbine combustor comprising:

a combustion liner having a center axis;

a cap assembly positioned adjacent the combustion liner, the cap assembly having a central opening located along the center axis and a plurality of openings located in an annular array about the center axis;

an end cover positioned adjacent the cap assembly, the end cover having a plurality of fuel nozzles fixed to the end cover with each fuel nozzle corresponding to an opening, such that a first fuel nozzle is positioned along the center axis and a plurality of second fuel nozzles are positioned in an annular array about the center axis;

wherein the first fuel nozzle comprises a solid inner tubular member having a centermost passage, a solid outer tubular member surrounding the inner tubular member thereby forming an outer passage between the inner tubular member and the outer tubular member, a plurality of fuel injectors extending radially outward from the outer passage, and a base coupled to the inner and outer tubular member and having openings for directing compressed air from within the combustion liner directly to the centermost passage so as to elevate a temperature of the inner tubular member; and, wherein the plurality of second fuel nozzles comprises an inner tubular member located coaxial with a centerline, the inner tubular member having a centermost passage, an intermediate tubular member surrounding the inner tubular member, the secondary tubular member having a cylindrical portion and a corrugated bellows portion forming a secondary passage between the inner tubular member and intermediate tubular member, an outer tubular member surrounding the secondary tubular member and forming an outer passage between the intermediate tubular member and the outer tubular member, a plurality of fuel injectors extending radially outward from the outer passage, and a base coupled to at least the outer tubular member and the intermediate tubular member and having a plurality of feed holes oriented at an angle relative to the centerline and extending to a surface of the base within the gas turbine combustor for directing compressed air from within the combustion liner directly to the intermediate tubular member for elevating a temperature of the intermediate tubular member.

9. The gas turbine combustor of claim 8 wherein the inner tubular member of the first fuel nozzle tapers from a first diameter to a smaller second diameter and tapers to a larger third diameter proximate a tip of the fuel nozzle.

10. The gas turbine combustor of claim 9, wherein the inner tubular member of the plurality of second fuel nozzles has a first diameter and the intermediate tubular member has a second diameter such that a tubular member ratio between the first diameter and second diameter is at least 0.65.

11. The gas turbine combustor of claim 10, wherein two or more of the plurality of second fuel nozzles simultaneously inject a fuel into the combustion liner while fuel is restricted to the first fuel nozzle.

12. The gas turbine combustor of claim 11, wherein two or more of the plurality of second fuel nozzles inject a fuel into the combustion liner while fuel is injected into the combustion liner by the first fuel nozzle.

* * * * *